US005235144A

United States Patent [19]

Matsui et al.

[11] Patent Number: 5,235,144

[45] Date of Patent: Aug. 10, 1993

[54] LINEAR MOTOR DRIVEN ELEVATOR

[75] Inventors: Nobuyuki Matsui, Chiba; Kazuyoshi Uchida, Kanagawa; Tadahiro Shimazu, Tokyo, all of Japan

[73] Assignee: Kajima Corporation, Tokyo, Japan

[21] Appl. No.: 740,382

[22] Filed: Aug. 5, 1991

[30] Foreign Application Priority Data

Aug. 7, 1990 [JP] Japan ..... 2-207606

[51] Int. Cl.[5] ..... B66B 9/00

[52] U.S. Cl. ..... 187/112

[58] Field of Search ..... 187/112; 310/12, 13

[56] References Cited

U.S. PATENT DOCUMENTS 5,090,516 2/1992 Grinaski et al. ..... 187/112

5,141,082 8/1992 Ishii et al. ..... 187/112

*Primary Examiner*—Steven L. Stephan

*Assistant Examiner*—Thomas M. Dougherty

*Attorney, Agent, or Firm*—Armstrong, Westerman, Hattori, McLeland & Naughton

[57] ABSTRACT

A linear motor driven elevator including in an elevator shaft, a fixed portion, an upper turning portion, and a lower turning portion. An ascending passage and a descending passage are sectionally formed between both turning portions in the fixed portion in a manner that the passages are positioned oppositely. A plurality of cages are accommodated in the passages, the cages being provided with permanent magnets which oppose the linear motor primary coils. Locking mechanisms for selectively locking the cages in position are provided. The turning portions each include a motor driven turn table which rotates the cage about the center axis of the elevator shaft to switch from the ascending to the descending passages and vice versa.

5 Claims, 6 Drawing Sheets

LINEAR MOTOR DRIVEN ELEVATOR

BACKGROUND OF THE INVENTION

The present invention relates to a linear motor driven elevator. More particularly, the present invention relates to a linear driven motor elevator especially useable in a high rise building having both high capacity and high speed.

Recently, many high rise building are being constructed. High speed elevators are required, and a variety of high speed elevators are known in the art. However, generally these high speed elevators include the same raising and lowering mechanism as in the prior art which is operated by winch drum. Being driven by such the raising and lowering mechanism, the amount of speed-up and transporting capacity of such high speed elevators are restricted.

OBJECT AND SUMMARY OF THE INVENTION

It is the object of the present invention to provide a linear motor driven elevator realizing both a high speed and a large capacity transportation, which is impossible for the prior art.

According to the present invention, a fixed portion, a lower turning portion and an upper turning portion are provided successively in a cylindrical elevator shaft. The fixed portion includes a center core supported by a pair of frames in a standing manner and linear motor primary coils oppositely positioned on periphery of the center core. The upper turning portion is provided at a position higher than the fixed portion while the lower turning portion is provided at a position lower than the fixed portion. The upper and lower turning portions are rotatable by a turning means. An ascending passage and a descending passage are sectionally formed by both turning portions, the fixed portion and the elevator shaft, with both passages being positioned oppositely. A plurality of cages are accommodated in both passages. The cages are provided with permanent magnets which are positioned opposite to the linear motor primary coils. Locking means for selectively locking each cage are provided between the cage and the frame.

Preferably, the turning means comprise a turn table fixed to the lower turning portion, a turn table suspended to the upper turning portion, crown gears provided on both of these tables, respectively, pinion gears engaging with the crown gears and turn table driving motors. Also, preferably, the locking means comprise recesses formed on the edge of the frame and a stopping device provided with a pin which protrudes into and engages with the recess. The pin protrudes when the cage is normally stopped, or in a state of emergency, such as cutting of a rope or cable suspending a cage, failure of the supply of electricity, etc. In a state of emergency, the pin operates a rock action as a safety device. Also, the pin protrudes when cages in upper and lower portions are turned respectively.

In the linear motor driven elevator being constructed as mentioned above, a linear synchronous motor (LSM) comprises linear motor primary coils of center core and permanent magnets of the cage. The cages ascend at a high speed through the ascending passage by means of the linear synchronous motor. When one of the cages attains to the upper turning portion, that cage is shifted into the descending passage by means of the upper turning portion. Then, the cage descends through the descending passage. Thereafter, upon reaching the lower turning portion, the cage is shifted into the ascending passage by means of the lower turning portion. In such a way, a plurality of cages ascend and descend successively in a cycle through the ascending passage and descending passage, respectively.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENT

Figure 1:
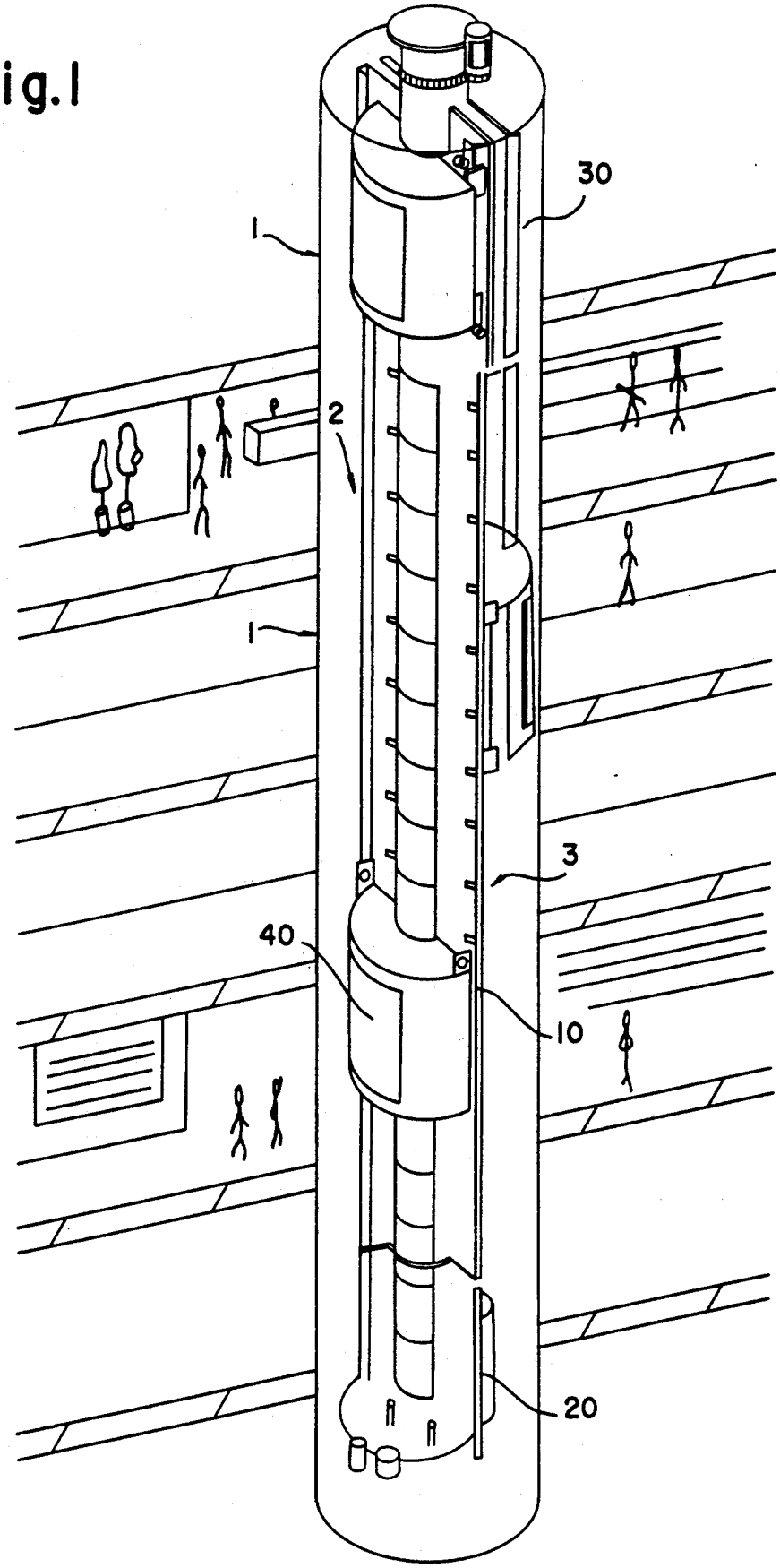
FIG. 1 is schematic perspective view of an embodiment of the present invention.

In FIG. 1, a cylindrical elevator shaft 1 comprises a fixed portion 10, a lower turning portion 20 and an upper turning portion 30. The lower turning portion 20 is provided at a position lower than the fixed portion 10 while the upper turning portion 30 is provided at a position higher than the fixed portion 10.

In the elevator shaft 1, an ascending passage 2 and a descending passage 3 are sectionally formed by the turning portions 20 and 30 and the fixed portion 10, in such a manner that the passages 2 and 3 are positioned oppositely. A plurality of cages 40 are accommodated in both passages 2 and 3.

Figure 2:
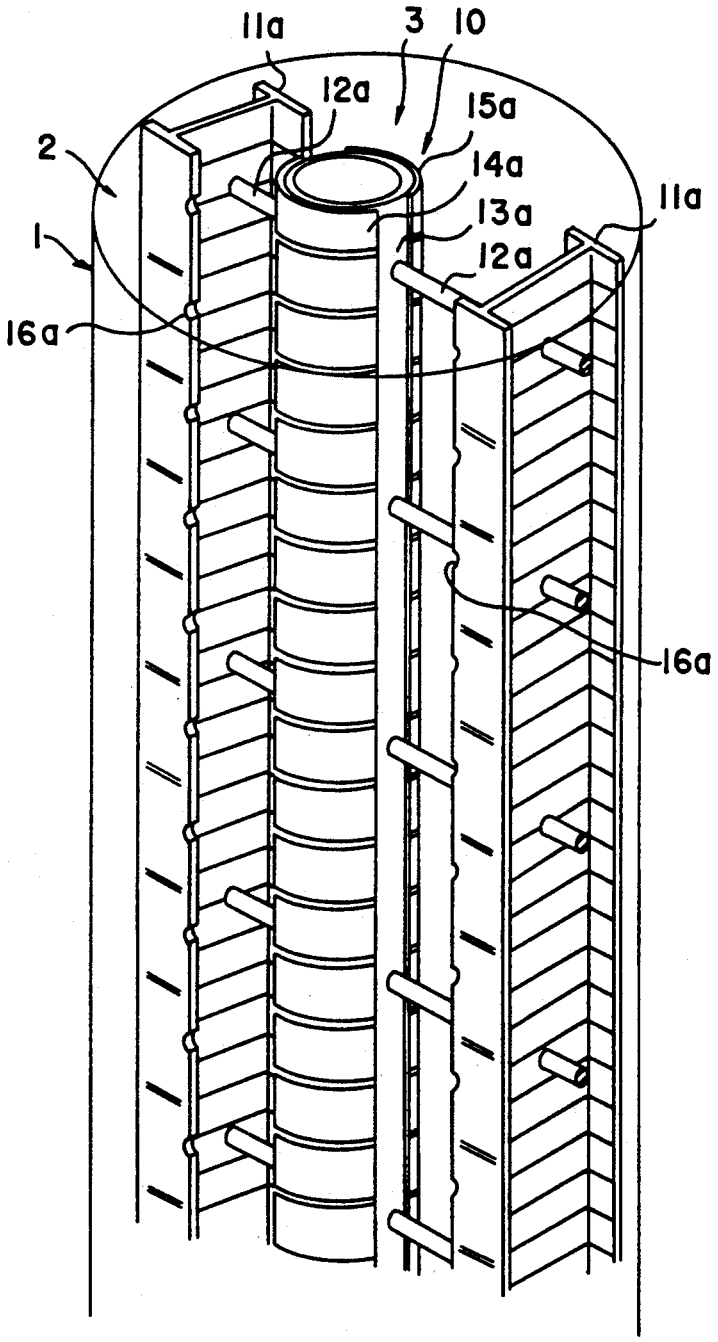
FIG. 2 is a partial perspective view showing a fixed portion.

In FIG. 2, in the fixed portion 10, a center core **13*a* is separated from and stands along with a pair of frames 11*a*, 11*a* made of H-profile steel by means of a plurality of pairs of arms 12*a*, 12*a*. The center core 13*a* is provided with linear motor primary coils 14*a*, 15*a*, arranged on opposite sides of the core to each other. A plurality of recesses 16*a* are formed at a predetermined pitch on the opposite edges of the both frames 11*a*, 11*a***.

Figure 3:
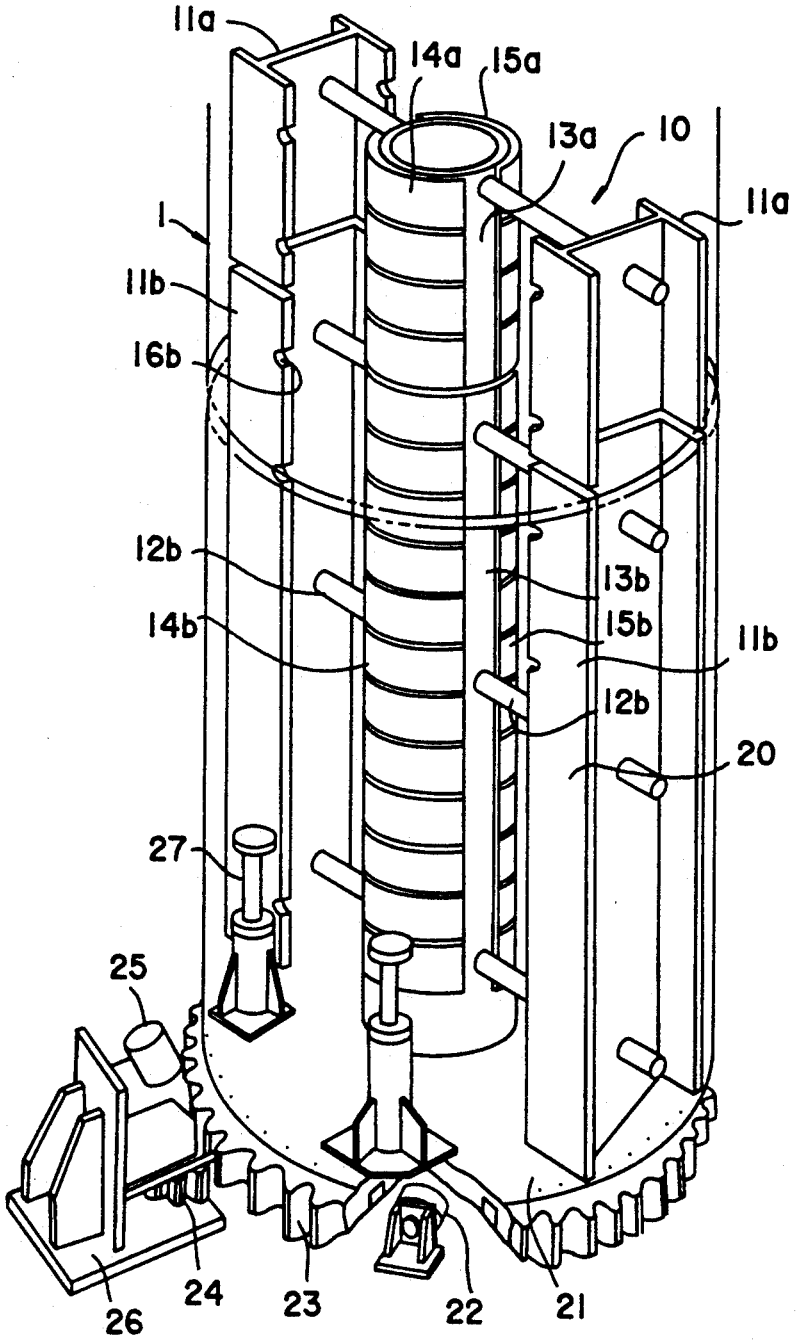
FIG. 3 is a partial perspective view showing a lower turning portion.

In FIG. 3, in the lower turning portion 20, the frames **11*b*, 11*b*, which are similar to the frames 11*a*, 11*a* in the fixed portion 10, stand on a turn table 21. A first turnable center core portion 13*b* is separated from and stands along with the frames 11*b*, 11*b*, by means of arms 12*b*, 12*b* on the turn table 21. Linear motor primary coils 14*b*, 15*b* are provided on the center core 13*b*. Recesses 16*b* are formed on the frames 11*b*, 11*b***.

The turn table 21 is supported by a plurality of rollers 22 being mounted to the fixed member (floor not shown). Dampers 27 are provided on the upper surface of the turn table 21, two for each passage 2, 3, respectively. A crown gear 23 is formed at the periphery of the turn table 21.

A pinion gear 24 engaging with the crown gear 23 is fixedly mounted to the fixed member (floor not shown), by a bracket 26. The bracket 26 is provided with a turn table driving motor 25 for rotating the pinion gear 24. The turning means of the lower turning portion 20 comprises these members 21–26.

Figure 4:
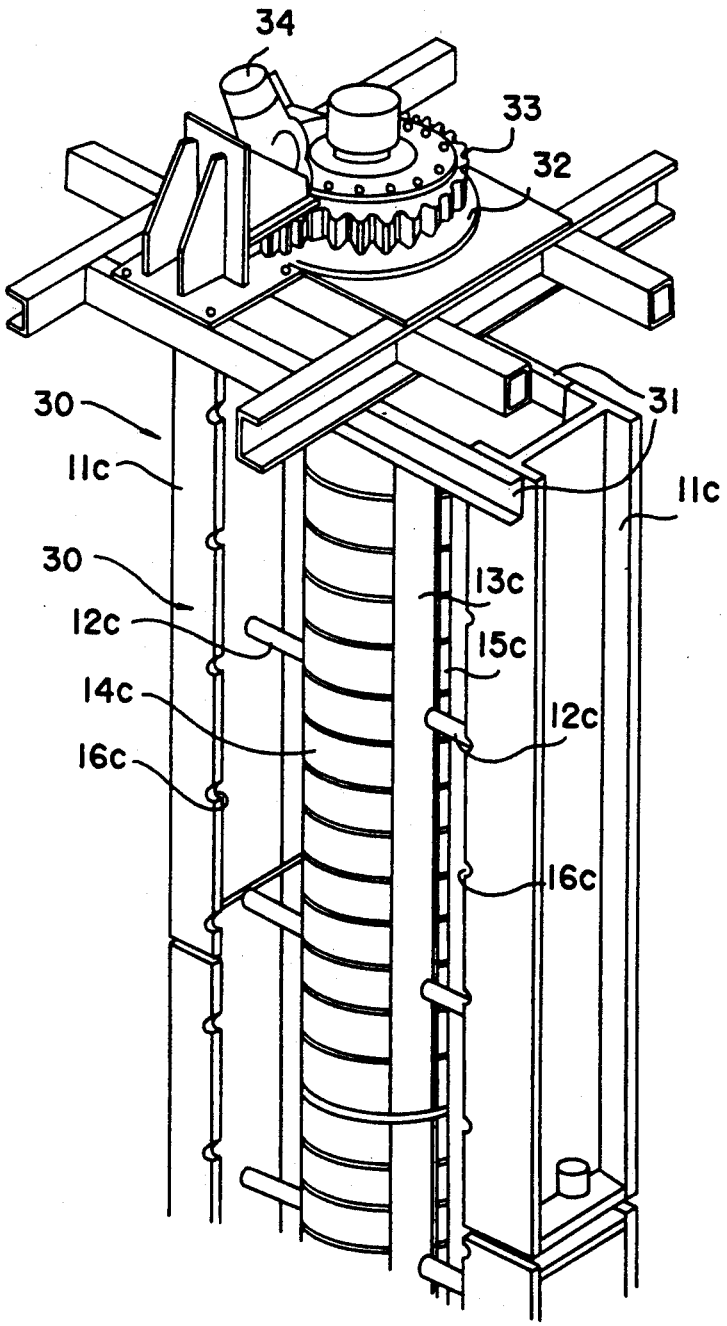
FIG. 4 is a partial perspective view showing a upper turning portion.

In FIG. 4, the upper turning portion 30 comprises substantially similar members as the lower turning portion 20, so that the corresponding members are designated by adding the suffix c, respectively, in order to avoid repetitive explanations. Frames 11c, 11c are mounted to the turntable 32, in suspension, by means of beams 31, 31, so, that the turn table 32 is turned by a crown gear 33, a pinion and a turn table driving motor 34. The turning means of the upper turning portion 30 comprises these members 32–34.

Figure 5:
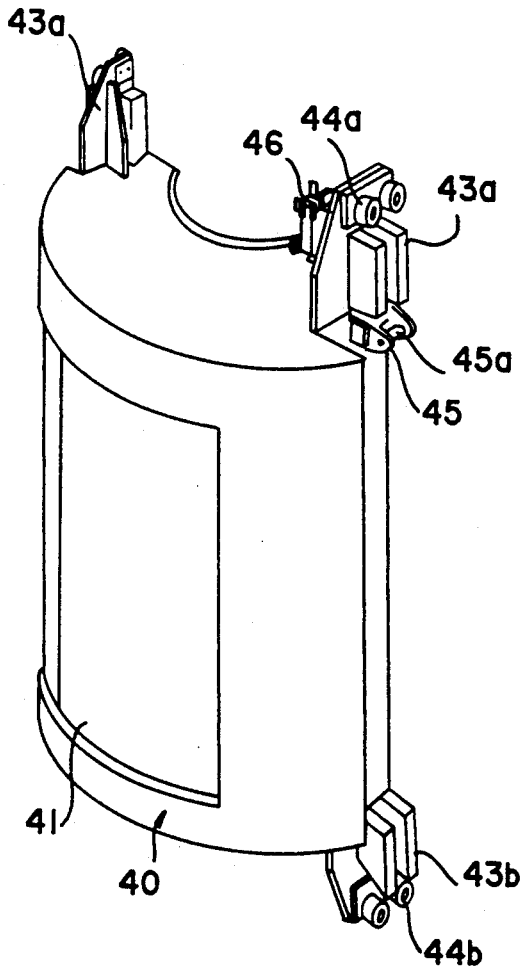
FIGS. 5 and 6 are partial perspective views showing the facing side and the back side of a cage, respectively.
Figure 6:
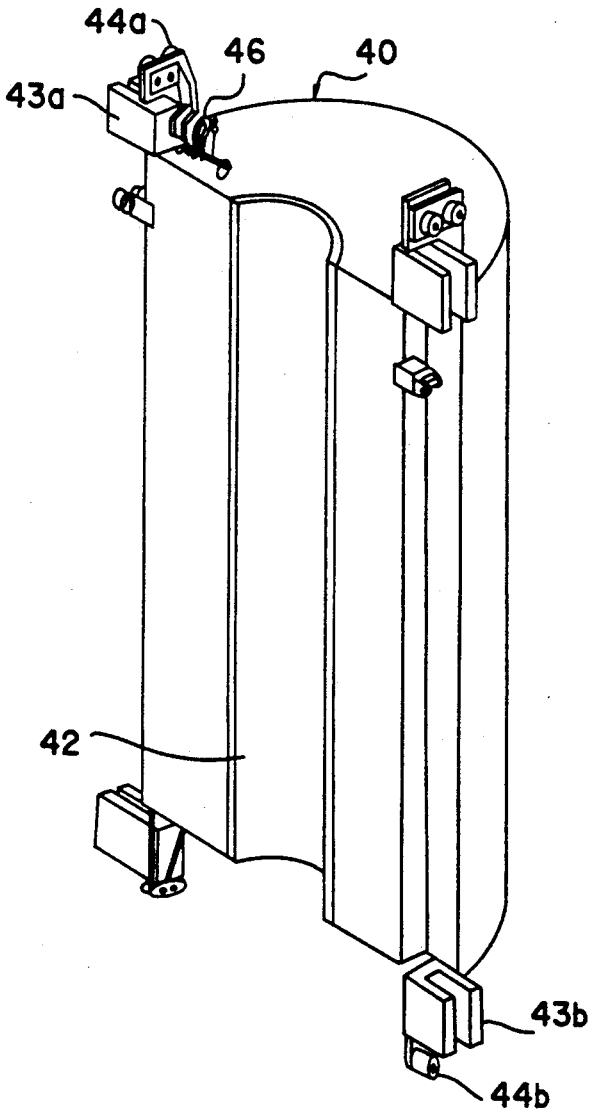

In FIGS. 5 and 6 (these drawings show a face side and a back side of a cage 40, respectively), the cage 40 is formed into a shape of cross-section surrounded by two circular arcs, with a door 41 mounted in the face side so as to be capable of opening and closing. While, in the back side of the cage 40, permanent magnets 42 are mounted so as to oppose the linear motor primary coils 14a–14c and 15a–15c. A linear synchronous motor, so-called LSM, comprises these linear motor primary coils 14a–14c, 15a–15c and permanent magnets 42. However, without being limited thereto, a linear induction motor, so-called SIM, etc. can be used.

Both upper and lower ends of the cage 40 are provided with upper guides 43a and upper guide rollers 44a, and lower guides 43b and lower guide rollers 44a for guiding by the edges of the frames 11a–11c. Below each upper guide 43a is a stopping device 45 comprising a pin 45a which engages with a recess 16a–16c in the frames 11a–11c by protruding at the time of stopping. A locking means comprises the stopping device 45 and recesses 16a–16c of frames 11a–11c. A current collector 46 is provided at the inside of one of the upper guides 43a.

By means of the present invention constructed as explained above, after the cage 40 ascends through the ascending passage 2 by means of linear synchronous motor driving mechanism, the cage 40 is shifted to the side of the descending passage 3 by the turning of the upper turning portion 30, and then, descends through the descending passage 3.

When the cage 40 should be stopped at a required position, the pin 45a of the stopping device 45 protrudes so as to fix the cage 40 to the frame 11a–11c by engaging with the recess 16a–16c.

Thereafter, the cage 40 is shifted to the side of the ascending passage 2 by the turning of the lower turning portion 20.

In such a way, a plurality of cages 40 ascend and descend successively in a cycle through the ascending passage 2 and the descending passage 3.

The present invention is constructed as explained above, thereby being capable of transporting a large number of passengers at a high speed by raising and lowering a plurality of cages at a high speed in a cycle through the ascending passage and the descending passage.

Also, by inserting cages in one shaft, a projection area of the elevator becomes relatively small, however, transporting capacity is improved. Also, a structural efficiency in a structure including an elevator according to the present invention will be improved.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A linear motor driven elevator comprising, successively in a cylindrical elevator shaft, a fixed portion, a lower turning portion and an upper turning portion;

said fixed portion including a center core, a pair of frames supporting said center core in a standing manner, and linear motor primary coils oppositely positioned on peripheries of the center core;

said upper turning portion being provided at a position higher than said fixed portion;

said lower turning portion being provided at a position lower than said fixed portion;

said upper and lower turning portions each being rotatable by a turning means;

an ascending passage and a descending passage sectionally formed by both turning portions, the fixed portion and the elevator shaft, in a manner that both passages are positioned oppositely;

a plurality of cages being accommodated in the both passages, said cages having permanent magnets positioned opposite the linear motor primary coils, a linear synchronous motor being defined by said primary coils and said permanent magnets; and locking means for selectively locking the cage between each cage and the frame;

whereby said ascending passage is disposed proximate to said upper turning portion for allowing ascending cages in said ascending passage to pass into said upper turning portion, said upper turning portion allowing rotation of a cage therein by the respective turning means from a position proximate to said ascending passage to a position proximate to said descending passage, said upper turning portion being disposed proximate to said descending passage so that a cage within said upper turning portion after rotating can pass downwardly to said descending passage;

and wherein said lower turning portion is disposed proximate to said descending passage for allowing descending cages in said descending passage to pass into said lower turning portion, said lower turning portion allowing rotation of a cage therein by the respective turning means from a position proximate to said descending passage to a position proximate to said ascending passage, said lower turning portion being disposed proximate to said ascending passage so that a cage within said lower turning portion after rotating can pass upwardly to said ascending passage.

2. The elevator as claimed in claim 1, wherein said turning means of said lower turning portion includes a turn table, a plurality of rollers supporting said turntable, a crown gear formed at the periphery of the turntable, a pinion gear engaging with the crown gear, a bracket mounting said pinion gear, and a turn table driving motor on said bracket for rotating the pinion gear.

3. The elevator as claimed in claim 1, wherein said turning means of said upper turning portion includes a turn table, beams positioned above said turn table, frames mounted to the turn table in suspension by said beams, a crown gear formed at the periphery of the turn table, a pinion gear engaging with the crown gear, a bracket mounting said pinion gear, and a turn table driving motor on said bracket for rotating the pinion gear.

4. The elevator as claimed in claim 1, wherein each cage has a cross-sectional shape defined by two semi-circular arcs, wherein a door is mounted in a face side of said cage, so as to be capable of opening and closing, the face side having a curved surface in accordance with one of the two semi-circular arcs, and wherein said permanent magnets are mounted in the back side of the cage so as to opposite the linear motor primary coils on said center core, the back side having a curved surface in accordance with the other of the two semi-circular arcs.

5. The elevator as claimed in claim 4, wherein upper and lower ends of each cage are provided with upper guides and upper guide rollers, and lower guides and lower guide rollers, respectively, for guiding by edges of the frames, each upper guide including a stopping device comprising a pin which engages with one recess of a plurality of recesses in a respective frame by protruding at the time of stopping of a cage at a predetermined position along the frame, said locking means comprising the stopping device and said plurality of recesses within the opposite frame for accommodating said pin of the respective cage and wherein a ground terminal is provided at an inside portion of one of the upper guides.

* * * * *